United States Patent [19]

Harris

[11] 3,959,186

[45] May 25, 1976

[54] PROCESS FOR MANUFACTURING DETERGENT BUILDERS

[75] Inventor: Dominic Richard Harris, Mount Waverley, Australia

[73] Assignee: ICI Australia Limited, Melbourne, Australia

[22] Filed: June 3, 1974

[21] Appl. No.: 475,915

[30] Foreign Application Priority Data

June 19, 1973 Australia ..... 3758/73

[52] U.S. Cl. ..... 252/551; 252/532; 260/458

[51] Int. Cl.[2] ..... C11D 1/14; C11D 1/831; C11D 11/04

[58] Field of Search ..... 252/551, 532; 260/458

[56] References Cited

UNITED STATES PATENTS

| | | | |
|---|---|---|---|
| 2,941,950 | 6/1960 | Korpi et al. | 252/153 |
| 3,413,331 | 11/1968 | Beiser et al. | 260/458 |
| 3,513,099 | 5/1970 | Hans et al. | 252/551 X |

FOREIGN PATENTS OR APPLICATIONS

| | | |
|---|---|---|
| 229,509 | 7/1960 | Australia |
| 1,472,561 | 1/1967 | France |

*Primary Examiner*—P. E. Willis, Jr.
*Attorney, Agent, or Firm*—Cushman, Darby & Cushman

[57] ABSTRACT

A process of manufacturing detergent builders which comprises:

1. treating a compound A of general formula I with from 0.5 to 3 moles of sulphating agent per mole of compound A under sulphating conditions;

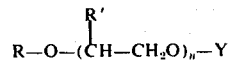

$$R-O-(\overset{R'}{\overset{|}{C}}H-CH_2O)_n-Y \qquad (I)$$

wherein R is a straight chain alkyl or alkenyl group containing from 8 to 20 inclusive carbon atoms substituted in the 2 position with either a methyl group or hydrogen atom, R′ is a hydrogen atom, or a methyl group or a mixture of hydrogen and methyl, Y is H; and *n* is selected from the range from 8 to 25 inclusive;

2. adding to the reaction mixture a compound B of general formula II and treating the mixture under sulphating conditions

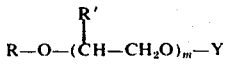

$$R-O-(\overset{R'}{\overset{|}{C}}H-CH_2O)_m-Y \qquad (II)$$

wherein R, R′, Y is as defined hereinabove and *m* is selected from the range 2 to 12 inclusive and wherein *n* minus *m* is greater than 3; and 3. neutralizing residual sulphating agent.

8 Claims, No Drawings

PROCESS FOR MANUFACTURING DETERGENT BUILDERS

This invention relates to detergent compositions in particular to non-phosphate containing detergent builders and to processes for making them.

In the past inorganic phosphate such as sodium tripolyphosphate have been widely used as builders for detergent compositions. Such phosphates are relatively expensive and also have been found to cause excessive growth of algae and bacteria in waterways and there is therefore a need for detergent compositions free of phosphate.

We have now found a cheap simple and versatile method of manufacturing non-phosphate detergent builders, which has the advantage that the properties of the detergent builders obtained in the process may be varied extremely easily. The detergent builders of our invention have both detergent and builder properties in alkaline media.

Accordingly, we provide a process of manufacturing detergent builders which comprises:

1. treating a compound A of general formula I with from 0.5 to 3 moles of sulphating agent per mole of compound A under sulphating conditions;

$$R-O-(\overset{R'}{\overset{|}{C}}H-CH_2O)_n-Y \qquad (I)$$

wherein R is a straight chain alkyl or alkenyl group containing from 8 to 20 inclusive carbon atoms substituted in the 2 position with either a methyl group or hydrogen atom, R′ is a hydrogen atom, or a methyl group or a mixture of hydrogen and methyl, Y is H; and $n$ is selected from the range from 8 to 25 inclusive;

2. adding to the reaction mixture a compound B of general formula II and treating the mixture under sulphating conditions $$R-O-(\overset{R'}{\overset{|}{C}}H-CH_2-O)_m-Y \qquad (II)$$

wherein R, R′, Y is as defined hereinabove and m is selected from the range 2 to 12 inclusive and wherein $n$ minus $m$ is greater than 3; and 3. neutralizing residual sulphating agent.

The more highly ethoxylated compounds A are harder to sulphate than the less highly ethoxylated compounds B and stage 1 of the above process even in the presence of excess sulphating agent does not proceed until all of A is sulphated but stops at an intermediate stage. The residual sulphating agent is however able to partially sulphate B and hence the product formed is a mixture of A, B, the sulphate of A (formula I, Y = $-OSO_3^-$). and the sulphate of B (formula II, Y = $-OSO_3^-$).

The nature of the sulphating agent is not narrowly critical and suitable agents are for example concentrated sulphuric acid (i.e. oleum or sulphur trioxide), chlorosulphonic acid and sulphamic acid.

By sulphating conditions, we mean the conditions required for the sulphating agent to sulphate alcohol alkoxylates. The conditions required for use of these agents are well-known to those skilled in the art. Typically, most sulphating agents require the mixture to be heated to a temperature in the range from 90° to 120°C but suitable conditions for sulphation by any given sulphating agent may be found by simple experiment.

The reaction mixture may be neutralized with any convenient neutralizing agent that is compatible with detergents. Such neutralizing agents are, for example, alkali metal hydroxides, such as caustic soda, or ammonium hydroxide.

Group R of formula I as defined hereinabove is a primary or secondary, straight chain or two methyl substituted straight chain, alkyl or alkenyl group containing from 8–20 carbon atoms, which chemical structure confers biodegradability to the composition in accordance with the requirements under test of the National Health and Medical Research Council of Australia. Such alkyl or alkenyl groups may be derived from natural fatty acids of animal or vegetable origin, or may be of the relatively recently produced linear synthetic alcohols such as for example: (1) carbonylation or "Oxo" alcohols manufactured from linear olefins, (2) "secondary alcohols" manufactured from linear paraffins, and (3) "Ziegler Alcohols" manufactured from ethylene.

Examples of such biodegradable alkyls or alkenyl groups are those of coconut fatty acid, whale oil alcohol, tallow derived fatty alcohol and $C_{11}$–$C_{15}$ carbon alcohols of "Dobanol 25" (Registered Trade Mark of Shell Chemicals Proprietary Limited Australia), or "Synprol" (Registered Trade Mark of ICI Australia Limited) and of "Oxocol KO" (Registered Trade Mark of Nissan Chemical Company of Japan). Further examples of biodegradable synthetic hydrophobes are the "Alfol" alcohols (Registered Trade Mark of Continental Oil Company, USA) and the linear secondary alcohols manufactured by Union Carbide.

For the preparation of detergent builders having particularly advantageous properties, we prefer that the weight ratio of A to B is in the range from 3 : 7 to 7 : 3, most preferably in the range from 3 : 7 to 5 : 5. We also prefer that the amount of sulphating agents added is from 1.0 to 2 moles per mole of A.

Particularly preferred builders are prepared by our process wherein compound A and B are such that $n$ minus $m$ is in the range from 8 to 20 and wherein R contains 10 to 15 carbon atoms.

Certain of the compositions prepared in our process are new and according to a further aspect of our invention we provide a detergent builder consisting of a mixture of Compound A of general formula I, Compound B of general formula II and the sulphates of Compound A and of Compound B, said mixture comprising from 15–25% w/w of A, from 15–25% w/w of B, from 15–25% w/w of A sulphate and from 15–45% w/w of B sulphate; wherein R, R′, $n$ and $m$ are as herebefore defined except that $n$ minus $m$ is in the range from 8 to 20 and R contains from 10 to 15 carbon atoms.

In use the detergent builders of our invention may be mixed with the normal additives for detergents known to those skilled in the art to give enhanced sequestering properties. These additives include:

a. Alkaline materials to provide a source of, preferably buffered, alkalinity to solutions of the compositions, for example, sodium carbonate, potassium carbonate, sodium bicarbonate, potassium bicarbonate, sodium sesquicarbonate, or triethanolamine.

b. Optionally other compounding ingredients which are known to be useful in detergent compositions. For example, the compositions may contain further detergent-active material such as nonionic, anionic, amphoteric or zwitterionic compounds or biocidally active compounds. Examples of such optimal compounding ingredients include soaps, alkyl benzene sulphonates, alkyl ether sulphates, olefin sulphonates. Other suitable compounding ingredients that can be used are amply illustrated in Schwartz and Perry, Vol I and Schwartz and Perry and Berch Vol II, "Surface Active Agents and Detergents" Interscience Publishers 1949 (Vol I) and 1958 (Vol II).

Inorganic phosphate may also be optionally used in the composition, typically at reduced levels of, for example, 10–15% in a powdered laundry detergent, which may be compared with the usual 20 to 60% levels used in spray dried powdered laundry detergent.

Other auxiliary ingredients which may be used and are commonly used in laundry detergent compositions are: sodium carboxy methyl cellulose as an antiredeposition agent, particularly for cotton textiles, glycol ether solvents to assist detergency, optical whiteners, bleaches, pigments and dyestuffs, and perfume, and fillers notably water and sodium sulphate.

The invention is illustrated by, but by no means limited to, the following examples:

EXAMPLE 1

207 parts of Dobanol 25 (Registered Trade Mark of Shell Chemical (Australia) Proprietary Limited for an 80% linear alkyl alcohol comprising 50% $C_{12} + C_{13}$ carbon chain alkyl and 50% $C_{14} + C_{15}$ carbon chain alkyl) were charged to a stainless steel pressure reactor fitted with a stirrer and means for heating and cooling. 4 parts of 47% sodium hydroxide aqueous solution was added and under a vacuum of 29 inches of mercury the charge was dehydrated at 120°C to 0.1% water content. After heating to 140°C, 528 parts of ethylene oxide was fed to the reactor, as fast as it would react, at pressures of between 20–30 psi and at between 140° and 160°C.

On cooling the batch to 50°C and continuing stirring, 110 parts of 98% sulphuric acid was quickly charged to the reaction mixture retaining 5% of the charge for control of degree of sulphation. After adjusting the temperature with some heating to 90°–5°C during sulphation, and allowing one-half hour for reaction, a cloud point was measured, 1% of composition in 6% sodium hydroxide solution and found to be 54.5°C, whereupon the retained 5% of sulphuric acid was charged, and raised this cloud point to 56°C.

On cooling the batch to 50°C again, 486 parts of "Teric" C12A4 (Registered Trade Mark of ICI Australia Limited for the condensate of a straight chain $C_{12}$–$C_{15}$ alcohol with 4 moles of ethylene oxide) was charged and stirred for one-fourth hour. At 30°C, 149 parts of 47% aqueous solution of caustic soda was charged to neutralize the product.

This liquid composition of the invention was a pale amber liquid of 500 cp viscosity, 500 Hazon on the American Public Health Association colour scale, with pour point 11°C, anionic agent content 33%, sodium sulphate content 8.5%, water content 9%, specific gravity 1.062 and pH of 1% aqueous solution of 8.

EXAMPLE 2

To a clean, dry reaction vessel was charged 2205 parts of Teric G12A12 (Registered Trade Mark of ICI Australia Limited for the 12 mole ethoxylate of a $C_{12}$–$C_{15}$ fatty alcohol) together with 18 parts of urea dissolved in 18 parts of water. On purging the contents of the reactor free of air with nitrogen and heating to 80°C, full vacuum was carefully applied to reduce the water content of the charge to less than 0.07%.

After breaking the vacuum with nitrogen and heating to 115°C, 30 parts of freshly sifted sulphamic acid was added to the reactor, the manhole closed and full vacuum applied maintaining better than 20 inches of mercury vacuum for minimum of 10 minutes. This vacuum was released, and using similar procedure, 5 more increments of 30 parts of sulphamic and one more increment of 44 parts was introduced into the reactor under similar conditions. One hour was allowed after the final addition of sulphamic acid for further dissolution and reaction of sulphamic acid, and the batch was sampled for a measurement of the content of anionic surfactant by the method of two phase titration. 61% anionic surfactant content was found. After cooling the batch to 50°C, 111 parts of solid caustic soda dissolved in 130 parts of water was added to the batch. With gradual application of heat and vacuum, the batch was stripped of ammonia finally under full vacuum and at 100°C.

1458 parts of Teric 12A4 (Registered Trade Mark of ICI Australia Limited for a 4 mole ethoxylate of a $C_{12}$–$C_{15}$ fatty alcohol), and 312 parts of water were added to the batch after cooling to 60°C and stirred for 30 minutes.

This composition of the invention was a pale amber liquid of 300 Hazen on the American Public Health Association scale of colour, 600 cm viscosity, an active agent content of 92.4%, water content of 7.6%, anionic agent content of 37.3%, a pH of 1% aqueous solution of 7.6, a specific gravity of 1.030, a pour point of 9°C, remaining fluid at temperatures above 15°C, and a cloud point of 1% of the composition in 6% aqueous sodium hydroxide solution of 40.5°C.

EXAMPLE 3

To a clean, dry reaction vessel was charged 5520 parts of Teric G12A12 (Registered Trade Mark of ICI Australia Limited for the 12 mole ethoxylate of a $C_{12}$–$C_{15}$ fatty alcohol) together with 37.5 parts of urea dissolved in 37.5 parts of water. On purging the contents free of air with nitrogen and heating to 110°C, full vacuum was carefully applied to dehydrate the charge to less than 0.6% water. After breaking the vacuum with nitrogen and heating to 115°C, 90 parts of freshly sifted, fine (95% minus 72 mesh) sulphamic acid was added to the reactor, the manhole closed and full vacuum applied, a vacuum of better than 20 inches of mercury being held for more than 10 minutes. This vacuum was released and a further 120 parts of freshly sifted, fine sulphamic acid was added and a vacuum applied as above. Further increments of addition of sulphamic acid; 150 parts, 120 parts, 82 parts were made followed in each instance by the above vacuum procedure. One hour was allowed after the final addition of sulphamic acid and the batch was sampled for a measurement of the content of anionic surfactant by two phase titration method. 70.9% anionic surfactant content as the ammonium salt of the sulphate of the 12 mole ethoxylate of $C_{12}$–$C_{15}$ alcohol was found.

After cooling the batch to 40°C, 615 parts of 47% caustic soda aqueous solution was added to the batch. With plenty of nitrogen blowing through the batch and venting the nitrogen and ammonia to atmosphere, the batch was slowly heated to 110°C and held with further nitrogen blowing for one hour. Then vacuum was gradually applied at 110°C to remove the final trace of ammonia. After 20 minutes full vacuum could be applied with no severe foaming occurring and the ammonia content was found to be 0.02%, and pH of a 1% aqueous solution 9.7.

3235 parts of Teric 12A3 (Registered Trade Mark of ICI Australia Limited for a 3 mole ethoxylate of $C_{12}$–$C_{15}$ fatty alcohol), 413 parts of monoethylene glycol methyl ether, and 89° parts of water were added to the batch and stirred for 1½ hours.

This product had a final anionic surfactant content of 35.2% of solids of 86.9%, a water content of 10.3%, pH of 1% aqueous solution was 9.7, and the liquid remained fluid for more than 1 hour at 10°C and displayed a pour point of 7°C.

Detergent efficiency was evaluated by measuring the capacity for dispersion of lime soap as follows. 2 g of a detergent composition comprising 0.2 g of a composition according to the invention together with 1.8 g of sodium carbonate were dissolved in one liter of water and were titrated under conditions of gently stirring in a 1½ l beaker with calcium magnesium mono-oleate which is generated in situ from the following solutions:

1. 10 WHO hard water, equivalent to 3420 ppm $CaCO_3$ hardness, made by dissolving 15.2 g $CaCl_2$ anhydrous and 6.98 g $MgCl_2.6H_2O$ in distilled water and making up to 5 1, and standardizing by EDTA titration against metallic zinc.
2. 0.0342 N sodium oleate made by making 9.63 g of oleic acid and 1.37 g of anhydrous NaOH up to 1 liter, with water.

Each solution, one at a time, is introduced into the beaker containing the detergent slowly by burette in increments not exceeding 20 ml. Two end points are observed, one at the appearance of the first haze, and the second more significant endpoint at the onset of relatively sudden coagulation of the colloidal suspension. This second end point gives a measure of capacity of the detergent composition to disperse lime soap.

0.2 parts of the composition prepared in this Example with 1.8 parts of sodium carbonate was found to have a capacity for lime soap dispersion of 770 mg calcium-magnesium-mono-oleate per g.

EXAMPLE 4

This example illustrates the preparation of domestic laundry detergent powders by blending the compositions of the invention.

To a ribbon blender the ingredients of each recipe below was charged and blended for 2 hours.

| | a | b | c | d | e | f |
|---|---|---|---|---|---|---|
| Composition of example 2 | 10.5 | 8.5 | 8.0 | | | |
| Composition of example 3 | | | | 10.0 | 10.0 | 10.0 |
| Sodium carbonate, light | 83.5 | 75.5 | 40.8 | 30.0 | 30.0 | 15.0 |
| Sodium carbonate | | | | 10.0 | 15.0 | 15.0 |
| Sodium metasilicate $5H_2O$ | 5.0 | 5.0 | 10.0 | | | |
| Sodium perborate | | | 10.0 | | | |
| Sodium sulphate | | | | 2.0 | 10.0 | 25.0 |
| Sodium tripolyphosphate | | 10.0 | 30.0 | 10.0 | 20.0 | 15.0 |
| Water | 0.2 | 0.2 | 0.2 | 19.0 | 14.0 | 19.0 |
| Cellofas B10* | 0.5 | 0.5 | 1.0 | 0.5 | 0.5 | 0.5 |
| Tinopal DMS* | 0.1 | 0.1 | | 0.1 | 0.1 | 0.1 |
| Tinopal 5MBS* | 0.1 | 0.1 | | 0.1 | 0.1 | 0.1 |
| Uvitex SOP (20%)* | 0.1 | 0.1 | | 0.1 | 0.1 | 0.1 |
| Fragrance | q.v | q.v | q.v | q.v | q.v | q.v |

*Registered Trade Marks

These powders were free flowing, attractive looking detergents which washed clothes, in qualitative practical washing tests, satisfactorily by comparison with the performance of conventional commercial powders.

EXAMPLE 5

This example illustrates further novel compositions of the invention. Tabletted laundry detergent powder which dissolves rapidly in water with effervescence, is made practical and feasible by the freedom from phosphates permitted by the compositions of the invention.

Ingredients in each recipe were charged to a powder blender of approximately cubical shape, suspended from two diagonally opposite corners and rotated therefrom on a horizontal axis by an electric motor, for 1 hour.

| | g | h | i |
|---|---|---|---|
| Composition of example 3 | 20 | 20 | 20 |
| Sodium bicarbonate | 15 | 15 | 15 |
| Soda ash light | 31.96 | 30.76 | 27.16 |
| Sodium metasilicate $5H_2O$ | 10 | 10 | 10 |
| Citric acid | 21.6 | | |
| Sodium dihydrogen phosphate | | 22.8 | |
| Sodium bisulphate | | | 26.4 |
| Cellofas B10* | 1 | 1 | 1 |
| Tinopal DMS* | 0.2 | 0.2 | 0.2 |
| Tinopal 5MBS* | 0.2 | 0.2 | 0.2 |
| Uvitex SOP (20%)* | 0.04 | 0.04 | 0.04 |
| | 100.00 | 100.00 | 100.00 |

*Registered Trade Marks

Following blending, these powders were allowed to age for one day, and then they were tabletted by pressing in a mandrel and die of 1 square inch area, a charge of 15 g of powder, at a force of 2 ton, to yield tablets which dissolved in water at 50°C in 2 to 3 minutes.

EXAMPLE 6

A series of builders was prepared by the following general method.

50 parts by weight of a compound A was charged into a stainless steel pressure reactor fitted with a stirrer and means of heating and cooling. Sulphuric acid (101%) was added to the batch quickly and the temperature of the charge adjusted to 90°–95°C for 30 minutes. The mixture was cooled to 50°C and 30 parts by weight of a compound B was added. The mixture was reheated to 90°–95°C for a further 30 minutes the mixture was cooled and neutralized to pH7 with from 7 to 10 parts by weight of 50% caustic soda solution. The builders were assessed qualitatively by the lime soap dispersity test as described in Example 3.

The ingredients used in each builder of the series is shown below.

| Series number of Builder | Compound A | | Compound B | | Sulphuric acid moles per mole of A |
|---|---|---|---|---|---|
| | No of carbon atoms in group R | n | No of carbon atoms in group R | m | |
| 1 | 16 | 9 | 9 | 5 | 2 |
| 2 | 16 | 9 | 9 | 5 | 1.2 |
| 3 | 12 | 23 | 12 | 9 | 2 |
| 4 | 12 | 23 | 12 | 9 | 1.2 |
| 5 | 16 | 22 | 17 | 3 | 2 |
| 6 | 16 | 22 | 17 | 3 | 1.2 |
| 7* | 9 | 8 | 9 | 6 | 2 |
| 8* | 9 | 8 | 9 | 6 | 1.2 |
| 9* | 16 | 9 | 16 | 9 | 2 |

*builders not of our invention for comparison only

The approximate analysis of the builders and their lime soap dispersancy is shown below.

| Series Number of Builder | Analysis in % w/w | | | | Lime soap dispersancy |
|---|---|---|---|---|---|
| | A | B | C | D | |
| 1 | 10–20 | 10–20 | 30–40 | 10–25 | Good |
| 2 | 15–30 | 15–25 | 25–40 | 5–15 | Good |
| 3 | 15–30 | 10–20 | 10–20 | 10–25 | Very Good |
| 4 | 5–20 | 15–25 | 5–20 | 10–20 | Good |
| 5 | 15–30 | 10–20 | 10–20 | 10–25 | Very Good |
| 6 | 5–25 | 15–25 | 5–25 | 10–25 | Good |
| 7 | 10–25 | 10–25 | 30–40 | 30–40 | Fair |
| 8 | 15–30 | 15–30 | 20–35 | 20–35 | Poor |
| 9 | 50–80 | — | 20–50 | — | Poor |

EXAMPLE 7

A series of builders was prepared by the general method of Example 6 using varying amounts of the compounds A and B and of sulphuric acid. The results are shown below. In each case compound A was Teric 12A23 and compound B was Teric 12A9.

| Series number of Builder | Parts by Compound A | Parts by Compound B | Sulphuric acid moles/mole of Compound A | Lime soap dispersancy |
|---|---|---|---|---|
| 10 | 50 | 10 | 2 | Poor |
| 11 | 50 | 20 | 2 | Fair |
| 12 | 50 | 40 | 2 | Very good |
| 13 | 50 | 50 | 2 | Excellent |
| 14 | 50 | 60 | 2 | Excellent |
| 15 | 50 | 70 | 2 | Very good |
| 16 | 50 | 80 | 2 | Good |

-continued

| Series number of Builder | Parts by Compound A | Parts by Compound B | Sulphuric acid moles/mole of Compound A | Lime soap dispersancy |
|---|---|---|---|---|
| 17 | 50 | 90 | 2 | Fair |
| 18 | 50 | 50 | 0.5 | Poor |
| 19 | 50 | 50 | 1 | Fair |
| 20 | 50 | 50 | 1.5 | Very good |
| 21 | 50 | 50 | 2.5 | Very good |
| 22 | 50 | 50 | 3 | Fair |

I claim:

1. A process of manufacturing detergent builders which comprises:

1. treating a compound A of general formula I with from 0.5 to 3 moles of sulphating agent per mole of compound A under sulphating conditions:

$$R{-}O{-}(\overset{\overset{\displaystyle R'}{|}}{C}H{-}CH_2O)_n{-}Y \qquad (I)$$

wherein R is a straight chain alkyl or alkenyl group containing from 8 to 20 inclusive carbon atoms substituted in the 2 position with either a methyl group or hydrogen atom, R′ is a hydrogen atom, or a methyl group or a mixture of hydrogen and methyl, Y is H; and *n* is selected from the range from 8 to 25 inclusive;

2. adding to the reaction mixture after sulfation in Step (1) has ceased a compound B of general formula II and treating the mixture under sulphating conditions until sulfation has ceased $$R{-}O{-}(\overset{\overset{\displaystyle R'}{|}}{C}H{-}CH_2O)_m{-}Y \qquad (II)$$

wherein R, R′, Y is as defined hereinabove and *m* is selected from the range 2 to 12 inclusive and wherein *n* minus *m* is greater than 3; and 3. neutralizing residual sulphating agent, the weight ratio of compound A to compound B being in the range from 3 : 7 to 7 : 3.

2. A process according to claim 1 wherein the weight ratio is in the range from 3 : 7 to 5 : 5.

3. A process according to claim 1 wherein the amount of sulphating agent added is from 1.0 to 2 moles per mole of compound A.

4. A process according to claim 1 wherein compounds A and B are such that n minus m is in the range from 8 to 20 and R contains from 10 to 15 carbon atoms.

5. A process according to claim 1 wherein the sulphating agent is chosen from the group consisting of concentrated sulphuric acid, oleum, sulphur trioxide, chlorosulphonic acid and sulphamic acid.

6. A process according to claim 5 wherein the sulphating conditions comprise heating the mixture in the presence of the sulphating agent to a temperature in the range from 90° to 120°C.

7. A process according to claim 1 wherein compounds A and B are condensates of a $C_{11}$–$C_{15}$ biodegradable synthetic alcohol mixture with ethylene oxide.

8. A detergent builder consisting of a mixture of Compound A of general formula I

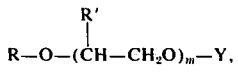

Compound B of general formula II

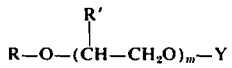

and the sulphates of Compound A and of Compound B, said mixture comprising from 15–25% w/w of A, from 15–25% w/w of B, from 15–25% w/w of A sulphate and from 15–45% w/w of B sulphate; wherein R is a straight chain alkyl or alkenyl group containing from 10 to 15 inclusive carbon atoms substituted in the 2 position with either a methyl group or hydrogen atom, R′ is a hydrogen atom, or a methyl group or a mixture of hydrogen and methyl, Y is H, *m* is selected from the range 2 to 12 inclusive, *n* is selected from the range from 8 to 25 inclusive and *n* minus *m* is in the range from 8 to 20.

* * * * *